United States Patent [19]

Rohrbach, deceased

[11] 4,087,052

[45] May 2, 1978

[54] VERTICAL IMPACT MILL FOR THE REDUCTION OF FOUR MICRON FINEST POWDER

[75] Inventor: Hans Rohrbach, deceased, late of Bergen, Germany, by Herta Rohrbach, administratrix

[73] Assignee: Ilok Power Co., Inc., Washington, D.C.

[21] Appl. No.: 763,133

[22] Filed: Jan. 27, 1977

Related U.S. Application Data

[63] Continuation of Ser. No. 586,607, Jun. 13, 1975, abandoned.

[30] Foreign Application Priority Data

Jun. 14, 1974 Germany ..... 2428626

[51] Int. Cl.[2] ..... B02C 13/18

[52] U.S. Cl. ..... 241/65; 241/154; 241/162; 241/188 R

[58] Field of Search ..... 241/29, 54, 57, 65, 241/154, 161, 162, 186 R, 188 R

[56] References Cited

U.S. PATENT DOCUMENTS

| | | | |
|---|---|---|---|
| 1,636,033 | 7/1927 | Agnew | 241/188 |
| 1,669,239 | 5/1928 | Grindle | 241/188 |
| 2,882,149 | 4/1959 | Willems | 241/162 |
| 3,065,919 | 11/1962 | Burkett et al. | 241/161 |
| 3,329,350 | 7/1967 | Wisgerhof et al. | 241/188 |

*Primary Examiner*—Granville Y. Custer, Jr,
*Attorney, Agent, or Firm*—Stevens, Davis, Miller & Mosher

[57] ABSTRACT

Vertical impact mill for production of very fine powders from larger nut-size pieces of coal, the mill including a series of horizontal impact wheels formed of wheel halves which connected together form an integral shaft-wheel system, the diameter of the impact wheels increasing from top to bottom of the mill, with an inlet at the top of the mill and successive chambers, each housing one impact wheel, and connected by connecting conduits offset from each other by 180°. The mill is designed for use with an inert gas to entrain the powder through and from the mill.

17 Claims, 4 Drawing Figures

FIG. 2
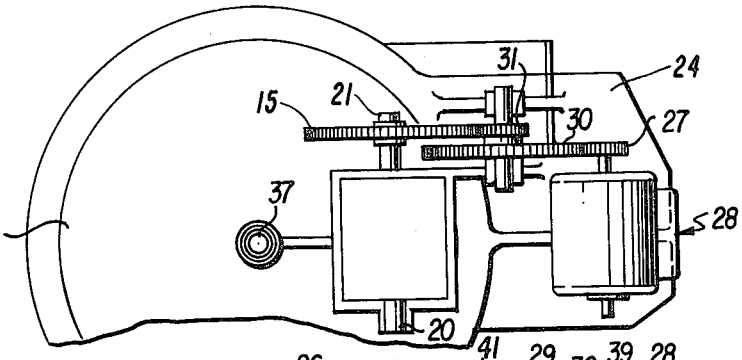
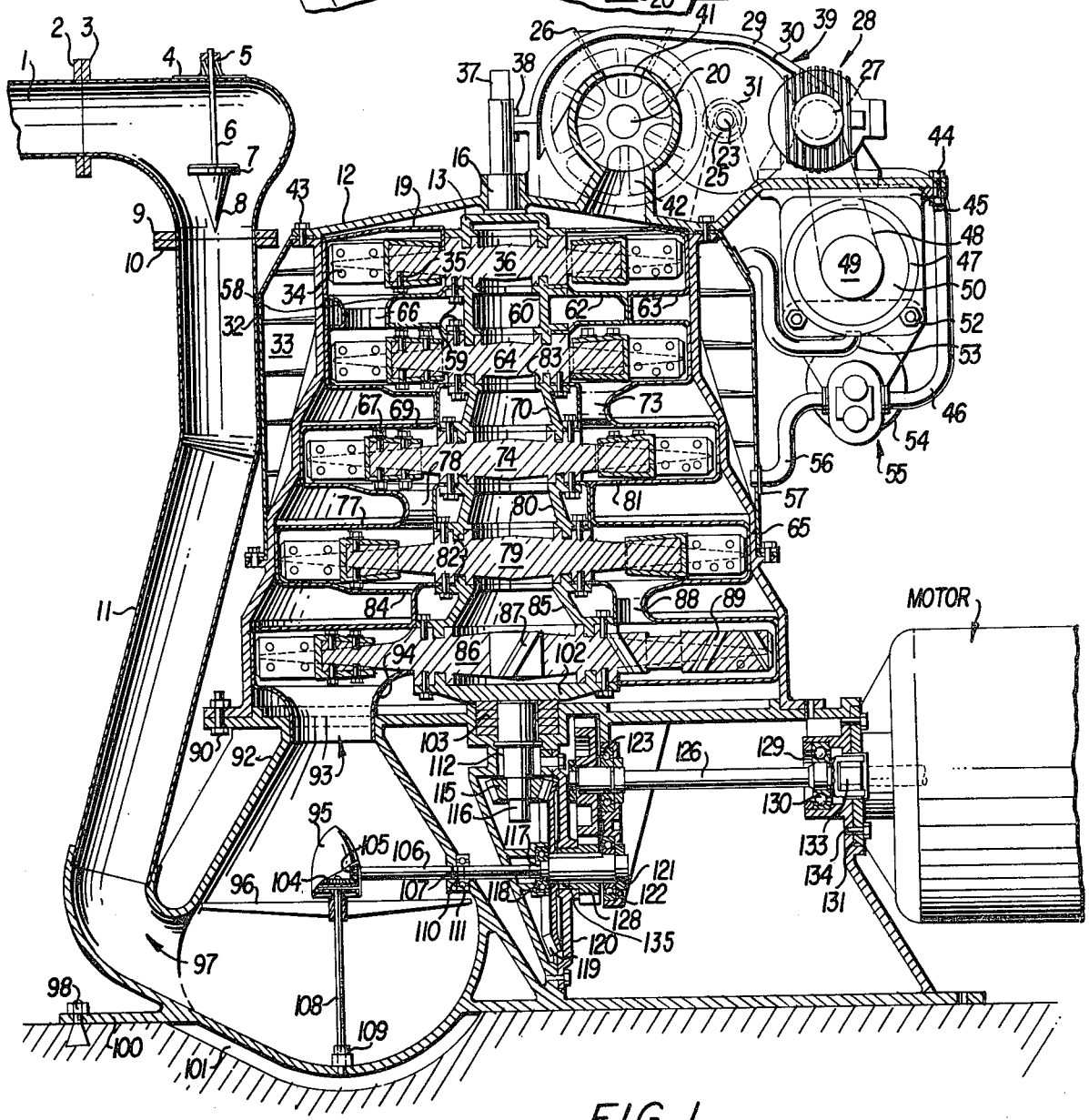
FIG. 1

VERTICAL IMPACT MILL FOR THE REDUCTION OF FOUR MICRON FINEST POWDER

This is a continuation of application Ser. No. 586,607 filed June 13, 1975 now abandoned.

By the impact mills of the art practiced to the present time, the main shaft always carried the grinding wheels horizontally arranged. For that reason the pulverized material has to be transported horizontally from the feeding place through the grinding wheels until exit of the powder. Such transport has been carried out with the help of powerful suction ventillators which tend to blow particles of pulverized material through the mill. However, such ventillators require high performance because the heavy particles often had the tendency to store themselves in the individual grinding chambers. To avoid such problems a revolving inner housing was necessary in such horizontal mills and by its slow rotation the stored pulverized particles were again poured into the grinding wheels. This revolving inner housing also required a corresponding performance cost due to both its construction and its operation. Such additional performance requirements are completely undesirable since they make the prime cost of the produced fine powder more expensive.

BRIEF SUMMARY OF THE INVENTION

It is therefore the basis of the present patent application a process by which the main shaft of the impact mill stands vertically so that the individual grinding wheels rotate on a horizontal level. Using an arrangement of this kind, by which the raw feed is poured into the top into the smallest of a series of grinding wheels of increasing diameter so that, the feed falls by its own weight further down from one of larger diameter impact grinding chamber into the next one. To prevent excessively rapid falling during processing of the powder, the transition canals from one chamber into the next one are always set opposed to each other by 180° in the rotary direction of the grinding wheels. In this manner the quantities of the feed material are always and invariably seized by the corresponding impact wheels and can pass only very slowly further down through the transition canals at the high rotary speeds of the impact wheels to thereby reach the next impact wheel chamber. Through this type of transport of the feed material, a substantial portion of the performance of the drive motor of the mill is saved, due to the fact that the overall quantity of the feed material is conveyed downward evenly and vertically. The larger feed material particles, that is specifically heavier particles, cannot store themselves as earlier, so that with this system the percent of particles of extreme fineness in the end product in increased. At the size of 4 microns this must be considered.

It can be recognized from the accompanying figures that the size of the five impact wheels changes from one grinding chamber to the next at a uniform ratio so that the peripheral speed of the impact plates on the last wheel is naturally many times larger than that of the preceding wheels. At a rotary speed of the shaft for the entire grinding system of 10,000 RPM, the peripheral speed of the largest wheel, whose diameter is 1225 mm. amounts to 650 meters/seconds. This is almost twice the speed of sound. This, however, means that even the very small powder particles from the preceding chamber are still further broken in the last chamber, purely by the impact of being hit in space. It is characteristic of this mill that it has a very small energy requirement, since in contrast to any other grinding methods, little energy is necessary to overcome friction or retardation as in other grinding or crushing methods. It is the absolute advantage of the pure impact mills that the feed material is comminuted exclusively by the impact hit in the grinding chambers.

This result depends on the form of the grinding chambers and their sheathing towards the shaft, which constitutes the basis for the speed of the gas in the chamber, and with this system the speed of the feed material of each chamber is always smaller than the peripheral speed of the impact wheel in that chamber. The difference of the two speeds is always so high that the powder particles coming from the preceding chamber will be hit so that they are again immediately comminuted. The relative speed between the feed material and the impact plates is still very high even in the last chamber, in which the feed material of the approximate size of about 10 micron is comminuted to 4 microns size.

It is noted that the first two grinding wheels, at the top of the device, are made in the same diameter since the first two wheels together represent only a fine prepulverizer in which the imcoming feed material is prepulverized from the size of nut-coal No. 4 = 20 - 25 mm, to about 1 - 2 mm size.

Since in this portion of the mill most of the heat evolves, a cooling sheath is built in from the third chamber upwards. Inside the cooling sheath is a helix line which conveys the cooling means, a fluid such as water and/or ammonia, from the entry opening below to the grinding chamber. There the cooling means goes to a circular cooler, which is aired through a ventillator. On the top the cooling means the fluid exits again from the cooler, goes to a circulation pump — here shown as a cog-wheel-pump — and back to the cooling sheath. The ventillator of the cooler is driven from an auxilliary motor, which at the same time also drives the apportioner for the feed material. Through an intermediate reduction-gear system, the apportioner is operated at a rotary speed of about 50 to 100 RPM, and it can, through a resistance control on the propulsion motor, be set to work so slowly or so rapidly that the hourly desired quantity delivered from the mill can be dependably regulated. Naturally it is clear that the operation of such fine powder reduction mills, especially when coal has to be comminuted, can be carried out only when a protective gas is used. In this case nitrogen is led into all the grinding chambers through special nozzles. This gas also functions as a carrier gas for the fine powder in the grinder mill when the powder empties from the bottom of the mill, below and with the help of a ventillator it is forced into the discharge conduit.

On its way out of the mill a baffle plate is built into the discharge conduit. This is a highly effective permanent magnet, which extends to is the circumference of a circular disc, but its center is not highly magnetic. Therefore over the center of this disc, concentrically with the center, is set a conically shaped member whose function is to guide the passing stream of powder, while any small metallic particles in the passing stream are positively captured at the edge of the magnet.

Immediately below the deepest point of the exhaust ventillator any resultant stone powders or other heavy particles which are unable to be carried by the main exhaust stream are collected. Each foreign body can be removed through a separate discharge opening, which is not marked herein.

Each impact wheel is built to comprise a body of uniform strength concentrically to its axis, with one part thereof on each side of a positioned center ring so that those parts can be bound with a double flange through a plurality of screw-joints set into the circumference of the double-flange, but they do not extend through the body of uniform strength. On the outer circumference of those rotary bodies, at a point of increasing thickness of the discs, an inlet milled part is built into each disc in such a manner that the area toward the center is narrower so that impact-plate shovels can be attached to the discs, and arranged at an angle to the planes of the circumference of the bodies of the same strength in positions in which the ends of the shovels of the impact-plate-carriers lie flat thereon and can be screwed thereto again in such a manner that the body of uniform strength cannot be pierced. The special impact-plate-carriers are therefore so arranged because it would be almost impossible, at any rate very costly, to find a hard metal, which could endure the very high tensil stresses of the rotation of the impact wheels at 10,000 RPM, and at the same time be so hard that the wear caused by the impact of the feed material upon these hitting plates would not very rapidly destroy the surfaces of such plates. According to my invention therefore, the standard soft iron plates are screwed onto the impact-plate-carriers in such a manner that the screw heads are set from behind, hence counter to the rotary direction of the impact plates in order to also protect screw heads from the wear. Thus, the length of the screws is so determined that in the soft iron plate will remain a small hole, when the screws have been tightened. In this manner a small portion of powder will remain in the hole on which then further additional powder will settle, and thus the powder itself will protect the screws from the wear effect. This process demonstrated excellent results in practice and it has the advantage of being very economical. The soft iron plates must be periodically replaced after a determined number of hours of work, depending on the kind of hardness of the material that has to be pulverized.

The propulsion of the main shaft is carried out from below through a bevel wheel gear with the help of an electric motor, which operates at about 1600 RPM. The horizontal main shaft of the electric motor is first connected with a spur-gear transmission and works continuously on the bevel wheel gear so that its vertical driver shaft works at about 10,000 RPM. The prolonged gear-shaft has at its free end the impulse system for the exit-output-propeller. This propeller works at about 1700 RPM.

The five different bodies of uniform strength, together with the interposed double flanges, which are screwed on opposite each other, form one hollow shaft, running from the top downward to the bottom, of very great strength and fitted for very high torque movement. This alone makes it possible for the shaft to be capable of working at such high rotary speeds without any harmful rotary or bending vibrations. The bedding of this shaft at its upper and lower end is carried out with slide bearings of a special construction, and the vertical forces of the shaft are born in a supporting bearing with rings made of Swedish steel. These rings will support the shaft at very high revolution numbers.

The conveyor funnel, which is not shown on the top of the reductor mill, is supplied with the raw feed material by a revolving transport band, the velocity of the band being comfortably synchronized with the apportioner at all times. The exiting powder goes either directly to the place of consumption or is stored in such a manner that the powder remains at all times under the inert gas. One such device works for a very long time without any disturbances.

BRIEF DESCRIPTION OF THE DRAWINGS

FIG. 1 is a partially schematic longitudinal section view of the inventive mill.

FIG. 2 is a partially cut away top view of the mill of FIG. 1.

DETAILED DESCRIPTION

Figure 3:
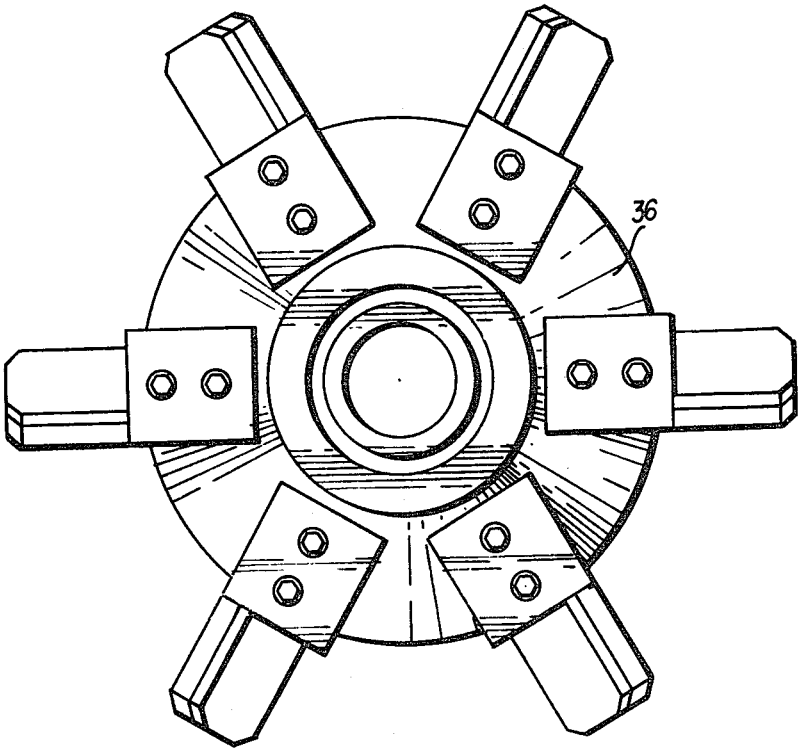
FIG. 3 is a top view of one of the impact wheels.

Let us start with the main shaft from the top as shown in FIG. 1. This shaft extends from the upper transverse bearing to the bottom transverse bearing 102. On the top of this shaft is affixed a portion having a square cross-section 37 for assembly purposes. The appertaining upper bearing shell 16 is positioned in the lid of the housing 12. This lid is kept on the housing 65 with the screws 43. The uppermost shaft journal 13 is screwed on to the impact wheel 36 with the help of an exactly fitting slot — as is also the case at 83, and with the help of screws 59 it is screwed on and it is exactly centered. FIG. 3 shows an impact wheel such as wheel 36 from a top view.

Downwards, the impact wheel 64 joins the double flange 60. Then follows the double flange 70, which, with the same kind of fitting as at 83, is linked with the impact wheel 74. For the reinforcement of the wheels and of the flanges the screws 59 are applied axially from each side of the wheel. On the impact wheel 74 is built and centered the double flange 80. Over the fitting 82 follows then the impact wheel 79 and on this one is again built the double flange 85. Here too the centering is carried out with the fitting 82 executed as above, while below the very strong conical double flange ring is used a similar, but in diameter a larger, fitting. With this last one the largest impact wheel 86 is centered and screwed on with the lower shaft journal.

Figure 4:
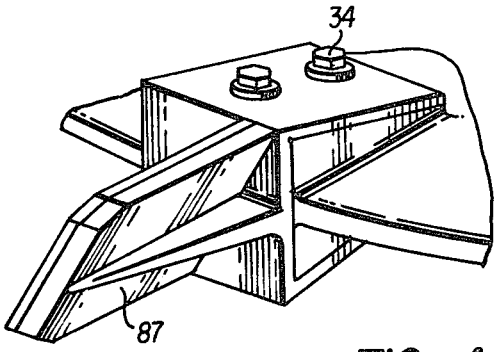
FIG. 4 is an isometric view of one of the diagonal shovel-blades.

On the impact wheel 86 are simultaneously indicated the diagonal shovels or blades 87 and 89, etc. These diagonal shovels are on all the impact wheels. On each one of the impact wheels 36 and 64 are 6 shovels; on the impact wheel 74 there are 8 shovels; on the impact wheel 79 there are 10 shovels; and finally on the wheel 86 there are 12 shovels. On the grinding-plate-carriers the soft iron protective plates are attached by the screws 34. One of the diagonal shovel-blades is shown in FIG. 4. The grinding plate carriers are on their side reinforced on the grinding wheels base bodies with the screws 35. The screws 67 are also used for that purpose.

In order not to expose portions of the shaft to the wear effect of the powder particles, these portions are provided with foil linings 62, 58, which are produced from two 180 degree pieces, in addition to the protective foil lining rings 69, 81, 84, 94, which are executed in one piece. These are the so called inner-powder linings. Additionally there are also the outer-powder-linings, which serve the purpose of protecting the case-housing parts. All these outer linings 19, 77 and 63 are constructed in two pieces so that these can be installed from the outside over the portions of the shaft and then can be secured in the housing. This means that the shaft runs freely within these outer linings.

Still belonging to the shaft is the lower transverse bearing marked and the rings 103 — made of Swedish steel — are built as the axial bearing.

The housing 65 stands with its lower end on a cast footpiece 92, on which it is held with screws 90. The casting foot contains the different bearings for the driving shaft of the reductor mill. To begin with there is the ball bearing 130 with the wear resistant screw 129; then further on the inside is the ball bearing 122.

The electric motor, which works at about 1650 RPM, is secured with a flange 131 to a counter-flange at the foot housing with the help of screws 134. The motor has a starting shaft 133, which meshes with notches into the counter-shaft 126. The the inner end of this shaft 126 is connected to drive a wheel having a bevel gear 119 thereon. A gear on the inner end of shaft 126 meshes with the pinion 128 which is secured on the shaft 106 with the help of longitudinal torsion resisting grooves. The shaft 106 is mounted in the ball bearings 122 with a fastening ring 121 and in the small ball bearing 118 with the fastening ring 117. Further on the inside lies then also the smallest ball bearing 111 with the bearing ring 110. The pinion 128 is connected with the large bevel wheel 119 and this last one meshes with small bevel wheel 115, which is held by the nut 116. The wheel box for the bevel wheels is closed with the lid 120, which contains the bearing shell 135 and which is secured with screws 113. The powder cap completely on the inside of the bearing 111 is marked 107.

The propeller which exhausts the product material and conveys it has the number 96 and revolves at about 1700 RPM. It is driven through the bevel gear set 105, 104. To prevent the settling of the powder on the bevel gears, a propeller sheath 95 is used. The propeller is attached to the shaft 108 which is rotably secured on the housing with the help of the nut 109.

The exit of the powder from the last impact wheel lies at 93 in the foot housing and at 97 the powder is further conveyed to the discharge pipe. To take up the indentation in the foot plate 100, the foundation of the reductor mill 101 is correspondingly grooved. The fastening screws for the casting portion of the foot are the provided with nuts 98.

The conveyed powder next reaches the ascending tube 11, which has its head curvature secured with flanges 10 and 9. In the head curvature hangs the magnet plate 7, on which is mounted the flow cone 8. On the top of the head curvature is welded the flange 4. This flange, with nuts 5, holds the magnet shaft 6. The end of the discharge conduit 1 is held by flanges 3 and 2.

Over the entire grinding chamber is provided the cooling housing 32, within which runs the screw-shaped water conduit 33. On the lid plate 12 hangs also the circular cooler 50. The inlet to the cooler is 53; the cooling funnel on the cooling surface is marked 47. In the cooling funnel runs a ventillator in known manner, which is not specifically indicated herein. The V-belt drive from the driving motor 28 to the ventillator is 48; the V-belt pulley hereto is 49. The inlet tube to the cooler is 53; the discharge tube is 46. The suspension of the cooler is 45; the screws appertaining thereto are 44. Again on the base for the cooler is the water pump 55 driven from wheel 54, suspended with the screws 52. The outlet tube from the pump is 56 and the inlet flange 57 for the cooling housing is 57. The driving motor for the colling is at the same time the propulsion for the apportioner of the feed material.

The motor revolves at about 1440 RPM and it carries on its shaft the pinion 27. That pinion meshes with the large front wheel 30. On this same shaft sits also the pinion 31 (400 RPM) meshing with the apportioning wheel 15 rotating at about 100 RPM. On that same shaft is secured the apportioner housing ring 41. The apportioner ring is open upwards for the inlet of the feed material and it is open downward for the falling of the powder into the impact wheel 36. The inlet is marked 41 and the outlet is marked 42.

It is important to recall that the transition openings — of which each is always displaced at 180 degrees — are marked from the impact wheel 36 to the impact wheel 64 as 66, from 64 to 74 as 73, from 74 to 79 as 78 and from 79 to 86 as 88.

The housing of the apportioner with the differently toothed wheels and with the apportioning wheel proper, is closed with a lid 29, which is held by the screws 38. To insure a regular inlet transportation of the feed material, an inlet funnel 26 is set above the apportioner 39. The feed material falls into this inlet funnel from a transport band, which is not shown herein. The propulsion of the transport band is synchronized with the rotary speed of the apportioner wheel so that by decreasing the revolution numbers of the apportioner wheel the transport band will also automatically run slower, so that through resistance control of the driving motor 28 the inlet speed of the feed material and therewith the hourly performance of the reductor mill can be regulated.

On the prolonged reductor mill housing lid 24 is built also the complete bearing 25 for the intermediate wheels 30. The shaft for this intermediate wheel is 23, but the shaft for the apportioner and for its drive is 20. The safety nut of the shaft is 21.

I claim:

1. An impact reduction mill for production of fine powder of diameter of about 4 microns, comprising:

a rotatably mounted vertical shaft integral with a plurality of impact wheels rotatable with said shaft;

the smallest of said impact wheels located nearest the top of said mill, with others of said plurality of impact wheels having increasingly greater diameters, the largest diameter impact wheel being nearest the bottom of said mill:

a casing for the mill enclosing said shaft and impact wheels and defining separate chambers for each of said plurality of wheels;

an impact opening at the top of said casing, and connections between each of said chambers for gravitational flow of powder from one chamber to the next lower chamber, with the connections between chambers alternately located 180° removed from each other with respect to the axis of rotation of the shaft and impact wheels.

2. The mill of claim 1 wherein there are five impact wheels.

3. The mill of claim 1, additionally comprising means for rotating said shaft at a speed of 10,000 rpm.

4. The mill of claim 3, wherein the largest diameter impact wheel has a diameter of 1250 mm.

5. The mill of claim 1 wherein each impact wheel carries at its outer periphery an even number of impact plates located in opposed pairs at opposite ends of a wheel diameter, the impact plates lying in planes which include a wheel diameter, with circumferentially successive impact plates each being inclined about 60°, in opposite directions, to the plane of revolution of the impact wheel to which they are attached.

6. The mill of claim 1 wherein the two topmost impact wheels have the same diameter.

7. The mill of claim 1, wherein successive wheels are connected by a short hollow shaft portion having upper and lower flanges through which the impact wheels are connected to the shaft and thereby to each other.

8. The mill of claim 7 wherein the lower flange of the shaft portion is of larger diameter than the upper flange, to thereby accomodate a larger impact wheel.

9. The mill of claim 7 wherein the short hollow shaft portions and the impact wheels are connected by head screws, said shaft portion and head screws, respectively, located concentrically thereby, with said impact wheels, forming the vertical shaft.

10. The mill of claim 1, additionally comprising a drive motor connected through a gear train for rotatably driving the vertical shaft.

11. The mill of claim 10, additionally comprising a supporting foot.

12. The mill of claim 1 additionally comprising a cooling housing surrounding the chambers of the three topmost impact wheels, said housing containing a spiral conduit for conveying a cooling medium from a pressure pump through the cooling housing in a bottom to top direction countercurrent to the flow of powder through the mill.

13. The mill of claim 1, additionally comprising a revolving apportioner on the top of the mill for receiving feed material through a fall funnel portion thereof, a transport band delivering feed material to the funnel, said transport band and the apportioner being synchronized.

14. The mill of claim 1, additionally comprising an exit conduit connected to an exit opening in the bottom of the casing, a blower located within the exit conduit for conveying fine powder from the exit opening through said exit conduit, with a magnetic plate located within said conduit downstream of said blower for removing metallic particles from fine powder flowing through said exit conduit.

15. The mill of claim 1, wherein each impact wheel comprises an integral body of uniform strength.

16. The mill of claim 1 wherein said impact wheels are located equidistantly spaced along said vertical shaft, with the diameter of said impact wheels increasing in an additive arithmetic progression.

17. The mill of claim 1 wherein said chambers and said connections between said chambers are formed by protective foils located within said casing.

* * * * *

UNITED STATES PATENT AND TRADEMARK OFFICE

CERTIFICATE OF CORRECTION

PATENT NO. : 4,087,052
DATED : May 2, 1978
INVENTOR(S) : Hans Rohrbach

It is certified that error appears in the above-identified patent and that said Letters Patent are hereby corrected as shown below:

Please correct the name of the Assignee as follows:

The Correct name is:

Ilok Powder Company, Inc.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*